US009728132B2

(12) United States Patent
Wu et al.

(10) Patent No.: US 9,728,132 B2
(45) Date of Patent: Aug. 8, 2017

(54) FOUR-TRANSISTOR-TWO-CAPACITOR AMOLED PIXEL DRIVING CIRCUIT AND PIXEL DRIVING METHOD BASED ON THE CIRCUIT

(71) Applicant: Shenzhen China Star Optoelectronics Technology Co., Ltd., Shenzhen (CN)

(72) Inventors: Yuanchun Wu, Shenzhen (CN); Yuying Cai, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 193 days.

(21) Appl. No.: 14/758,962

(22) PCT Filed: May 13, 2015

(86) PCT No.: PCT/CN2015/078828

§ 371 (c)(1),
(2) Date: Jul. 2, 2015

(87) PCT Pub. No.: WO2016/155087

PCT Pub. Date: Oct. 6, 2016

(65) Prior Publication Data

US 2017/0039941 A1 Feb. 9, 2017

(30) Foreign Application Priority Data

Mar. 27, 2015 (CN) ..... 2015 1 0140733

(51) Int. Cl.
*G09G 3/32* (2016.01)
*G09G 3/3258* (2016.01)

(52) U.S. Cl.
CPC ..... *G09G 3/3258* (2013.01); *G09G 3/32* (2013.01); *G09G 2300/0819* (2013.01);
(Continued)

(58) Field of Classification Search
CPC ..... G09G 3/3258; G09G 2300/0819; G09G 2310/061
(Continued)

(56) References Cited

U.S. PATENT DOCUMENTS

2012/0306840 A1* 12/2012 Han ..... G09G 3/003 345/212
2014/0320473 A1* 10/2014 Ma ..... G09G 3/3233 345/211
2015/0161940 A1* 6/2015 Woo ..... G09G 3/003 345/58

FOREIGN PATENT DOCUMENTS

CN 101847363 A 9/2010

* cited by examiner

*Primary Examiner* — Jonathan Blancha
(74) *Attorney, Agent, or Firm* — Leong C. Lei

(57) ABSTRACT

The present invention provides an AMOLED pixel driving circuit and a pixel driving method. The AMOLED pixel driving circuit utilizes the 4T2C structure, comprising a first, a second, a third, a fourth thin film transistors (T1, T2, T3, T4), a first, a second capacitor (C1, C2) and an organic light emitting diode (OLED) with introducing a first, a second global signals (Vselx, Vsely) and a reference voltage (Vref); by providing the reference voltage (Vref) to the first node (a) via the third thin film transistor (T3), the data signal voltage (Vdata) can be simplified to diminish the complexity of the data signal voltage (Vdata). The process of writing the data signal voltage (Vdata) into the first thin film transistor T1, i.e. the driving the thin film transistor is separated from the reset stage (Reset) and the threshold voltage detection stage (Vth sensing) with the fourth thin film transistor (T4). Thus, the reset time and the compensation time can be increased to effectively compensate the threshold voltage changes of the drive thin film transistor and the display brightness of the AMOLED becomes more even to raise the display quality.

4 Claims, 11 Drawing Sheets

(52) U.S. Cl.
CPC ..... *G09G 2310/061* (2013.01); *G09G 2320/0233* (2013.01); *G09G 2320/045* (2013.01)

(58) Field of Classification Search
USPC ..... 345/82
See application file for complete search history.

FOUR-TRANSISTOR-TWO-CAPACITOR AMOLED PIXEL DRIVING CIRCUIT AND PIXEL DRIVING METHOD BASED ON THE CIRCUIT

FIELD OF THE INVENTION

The present invention relates to a display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmit voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, which shows a 2T1C pixel driving circuit employed for AMOLED according to prior art, comprising a first thin film transistor T10, a second thin film transistor T20 and a capacitor Cs. The first thin film transistor T10 is a drive thin film transistor, and the second thin film transistor T20 is a switch thin film transistor, and the capacitor Cs is a storage capacitor. Specifically, a gate of the second thin film transistor T20 is electrically coupled to a scan signal voltage Vsel, and a source is electrically coupled to a data signal voltage Vdata, and a drain is electrically coupled to a gate of the first thin film transistor T10 and one end of the capacitor Cs; a source of the first thin film transistor T10 is electrically coupled to an alternating current power supply voltage Vdd, and a drain is electrically coupled to an anode of the organic light emitting diode D; a cathode of the organic light emitting diode D is electrically coupled to an earth; the one end of the capacitor Cs is electrically coupled to the drain of the second thin film transistor T20, and the other end is electrically coupled to the source of the first thin film transistor T10.

Please refer to FIG. 2. FIG. 2 is a sequence diagram corresponding to the circuit in FIG. 1. As shown in FIG. 2, the working procedure of the 2T1C pixel driving circuit shown in FIG. 1 is divided into four stages, which specifically are: 1. a reset stage, the scan signal voltage Vsel provides high voltage level for controlling the second thin film transistor T20 to be activated, and the data signal voltage Vdata provides a first reference voltage Vref1 to the gate of the first thin film transistor T10 via the second thin film transistor T20. The gate voltage of the first thin film transistor T10, Va=Vref1, and the first thin film transistor T10 is activated, and an alternating current power supply voltage Vdd provides low voltage level Vdl, and then, the source voltage of the first thin film transistor T10, Vb=Vdl; 2. a threshold voltage detection stage, the scan signal voltage Vsel provides high voltage level for controlling the second thin film transistor T20 to be activated, and the data signal voltage Vdata provides a second reference voltage Vref2 to the gate of the first thin film transistor T10 via the second thin film transistor T20, and Vref2<Vref1. The gate voltage of the first thin film transistor T10, Va=Vref2, and the first thin film transistor T10 is activated, and the alternating current power supply voltage Vdd provides high voltage level, and the source voltage Vb of the first thin film transistor is raised that Vb=Vref2−Vth, and Vth is a threshold voltage of the first thin film transistor T10; 3. a threshold voltage compensation stage, the scan signal voltage Vsel provides high voltage level for controlling the second thin film transistor T20 to be activated, and the data signal voltage Vdata provides a data signal voltage Vdata to the gate of the first thin film transistor T10 and the capacitor Cs via the second thin film transistor T20. The gate voltage Va of the first thin film transistor T10=Vdata, and the first thin film transistor T10 is activated, and an alternating current power supply voltage Vdd provides high voltage level, and, the source voltage Vb of the first thin film transistor T10 is changed to Vb=Vref2−Vth+ΔV, and ΔV is the influence generated by the data signal voltage Vdata to the source voltage of the first thin film transistor T10; 4. A drive stage, the scan signal voltage Vsel provides low voltage level, and the second thin film transistor T20 is deactivated. With the storage function of the capacitor Cs, the gate voltage of the second thin film transistor T20 can be maintained to be the data signal voltage, Va=Vdata so that the first thin film transistor T10 is in an activated state. The source voltage of the first thin film transistor T10, Vb=Vref2−Vth+ΔV, and the gate-source voltage of the first thin film transistor T10, Vgs=Va−Vb=Vdata−Vref2+Vth−ΔV. The threshold voltage of the drive thin film transistor can be compensated. However, drawbacks of complicated data signal voltage and short compensation time exist in the 2T1C pixel driving circuit shown in FIG. 1.

SUMMARY OF THE INVENTION

An objective of the present invention is to provide an AMOLED pixel driving circuit, which can effectively compensate the threshold voltage changes of the drive thin film transistor for simplifying the data signal voltage and diminishing the complexity of the data signal voltage to make the display brightness of the AMOLED more even and to raise the display quality.

Another objective of the present invention is to provide an AMOLED pixel driving method, which can effectively compensate the threshold voltage changes of the drive thin film transistor for simplifying the data signal voltage and diminishing the complexity of the data signal voltage to make the display brightness of the AMOLED more even and to raise the display quality.

For realizing the aforesaid objectives, the present invention provides an AMOLED pixel driving circuit, comprising: a first thin film transistor, a second thin film transistor, a third thin film transistor, a fourth thin film transistor, a first capacitor, a second capacitor and an organic light emitting diode;

a gate of the first transistor is electrically coupled to a first node, and a source is electrically coupled to a second node, and a drain is electrically coupled to an alternating current power supply voltage;

a gate of the second thin film transistor is electrically coupled to a scan signal voltage, and a source is electrically coupled to a data signal voltage, and a drain is electrically coupled to a third node;

a gate of the third thin film transistor is electrically coupled to a second global signal, and a source is electrically coupled to the first node and a drain is electrically coupled to a reference voltage;

a gate of the fourth thin film transistor is electrically coupled to a first global signal, and a source is electrically coupled to the third node, and a drain is electrically coupled to the first node;

one end of the first capacitor is electrically coupled to the third node, and the other end is electrically coupled to a cathode of the organic light emitting diode and an earth;

one end of the second capacitor is electrically coupled to the first node, and the other end is electrically coupled to the second node;

an anode of the organic light emitting diode is electrically coupled to the second node, and the cathode is electrically coupled to the earth;

the first thin film transistor is a drive thin film transistor.

All of the first thin film transistor, the second thin film transistor, the third thin film transistor and the fourth thin film transistor are Low Temperature Poly-silicon thin film transistors, oxide semiconductor thin film transistors or amorphous silicon thin film transistors.

Both the first global signal and the second global signal are generated by an external sequence controller.

The first global signal, the second global signal, the scan signal voltage and the alternating current power supply voltage are combined with one another, and correspond to a reset stage, a threshold voltage detection stage, a threshold voltage compensation stage and a drive stage one after another;

in the reset stage, the scan signal voltage and the second global signal are high voltage levels, and the first global signal and the alternating current power supply voltage are low voltage levels;

in the threshold voltage detection stage, the second global signal and the alternating current power supply voltage are high voltage levels, and the scan signal voltage and the first global signal are low voltage levels;

in the threshold voltage compensation stage, the scan signal voltage and the second global signal are low voltage levels, and the first global signal and the alternating current power supply voltage are high voltage levels;

in the drive stage, the scan signal voltage, the first global signal and the second global signal are low voltage levels, and the alternating current power supply voltage is high voltage level.

The reference voltage is a constant voltage.

The present invention further provides an AMOLED pixel driving circuit, comprising: a first thin film transistor, a second thin film transistor, a third thin film transistor, a fourth thin film transistor, a first capacitor, a second capacitor and an organic light emitting diode;

a gate of the first transistor is electrically coupled to a first node, and a source is electrically coupled to a second node, and a drain is electrically coupled to an alternating current power supply voltage;

a gate of the second thin film transistor is electrically coupled to a scan signal voltage, and a source is electrically coupled to a data signal voltage, and a drain is electrically coupled to a third node;

a gate of the third thin film transistor is electrically coupled to a second global signal, and a source is electrically coupled to the first node and a drain is electrically coupled to a reference voltage;

a gate of the fourth thin film transistor is electrically coupled to a first global signal, and a source is electrically coupled to the third node, and a drain is electrically coupled to the first node;

one end of the first capacitor is electrically coupled to the third node, and the other end is electrically coupled to a cathode of the organic light emitting diode and an earth;

one end of the second capacitor is electrically coupled to the first node, and the other end is electrically coupled to the second node;

an anode of the organic light emitting diode is electrically coupled to the second node, and the cathode is electrically coupled to the earth;

the first thin film transistor is a drive thin film transistor;

wherein all of the first thin film transistor, the second thin film transistor, the third thin film transistor and the fourth thin film transistor are Low Temperature Poly-silicon thin film transistors, oxide semiconductor thin film transistors or amorphous silicon thin film transistors;

wherein both the first global signal and the second global signal are generated by an external sequence controller.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a first capacitor, a second capacitor and an organic light emitting diode;

a gate of the first transistor is electrically coupled to a first node, and a source is electrically coupled to a second node, and a drain is electrically coupled to an alternating current power supply voltage;

a gate of the second thin film transistor is electrically coupled to a scan signal voltage, and a source is electrically coupled to a data signal voltage, and a drain is electrically coupled to a third node;

a gate of the third thin film transistor is electrically coupled to a second global signal, and a source is electrically coupled to the first node and a drain is electrically coupled to a reference voltage;

a gate of the fourth thin film transistor is electrically coupled to a first global signal, and a source is electrically coupled to the third node, and a drain is electrically coupled to the first node;

one end of the first capacitor is electrically coupled to the third node, and the other end is electrically coupled to a cathode of the organic light emitting diode and an earth;

one end of the second capacitor is electrically coupled to the first node, and the other end is electrically coupled to the second node;

an anode of the organic light emitting diode is electrically coupled to the second node, and the cathode is electrically coupled to the earth;

the first thin film transistor is a drive thin film transistor;

step 2, entering a reset stage;

the scan signal voltage and the second global signal provide high voltage levels, and the first global signal and the alternating current power supply voltage provide low voltage levels, and the first, the second, the third thin film transistors are activated, and the fourth thin film transistor is deactivated, and a data signal voltage Vdata is written into the third node and the first capacitor line by line, and the first node is written with a reference voltage Vref, and the second node is written with low voltage level of the alternating current power supply voltage;

step 3, entering a threshold voltage detection stage;

the second global signal and the alternating current power supply voltage provide high voltage levels, and the scan signal voltage and the first global signal provide low voltage levels, and the first, the third thin film transistors are activated, and the second, the fourth thin film transistors are deactivated, and the data signal voltage Vdata is stored in the first capacitor, and the first node is maintained at the reference voltage Vref, and a voltage level of the second node is raised up to Vref−Vth, wherein Vth is a threshold voltage of the first thin film transistor;

step 4, entering a threshold voltage compensation stage;

the scan signal voltage and the second global signal provide low voltage levels, and the first global signal and the alternating current power supply voltage provide high voltage levels, and the second, the third thin film transistors are deactivated, and the first, the fourth thin film transistors are activated, and the data signal voltage Vdata stored in the capacitor is written into the first node, and a voltage level of the first node is changed to the data signal voltage Vdata, and the voltage level of the second node is changed to Vref−Vth+ΔV, and ΔV is an influence generated by the data signal voltage to a source voltage of the first thin film transistor, which is the voltage level of the second node;

step 5, entering a drive stage;

all the scan signal voltage, the first global signal and the second global signal provide low voltage levels, and the alternating current power supply voltage provide high voltage levels, and the second, the third, the fourth thin film transistors are deactivated, and the first thin film transistor is activated, and with the storage function of the second capacitor, the voltage level of the first node, which is the gate voltage level of the first thin film transistor is maintained to be:

$$Vg=Va=Vdata$$

wherein Vg represents a gate voltage level of the first thin film transistor, and Va represents a voltage level of the first node;

the voltage of the second node, i.e. the source voltage of the first thin film transistor remains to be:

$$Vs=Vb=Vref-Vth+\Delta V$$

wherein Vs represents a source voltage level of the first thin film transistor, and Vb represents the voltage level of the second node;

the organic light emitting diode emits light, and a current flowing through the organic light emitting diode is irrelevant with the threshold voltage of the first thin film transistor.

All of the first thin film transistor, the second thin film transistor, the third thin film transistor and the fourth thin film transistor are Low Temperature Poly-silicon thin film transistors, oxide semiconductor thin film transistors or amorphous silicon thin film transistors.

Both the first global signal and the second global signal are generated by an external sequence controller.

The reference voltage is a constant voltage.

The benefits of the present invention are: the present invention provides an AMOLED pixel driving circuit and a pixel driving method. The pixel driving circuit utilizing the 4T2C structure implements compensation to the threshold voltage of the drive thin film transistor in each of the pixels. By providing the reference voltage to the first node via the third thin film transistor, the data signal voltage can be simplified to diminish the complexity of the data signal voltage. The process of writing the data signal voltage into the driving the thin film transistor is separated from the reset stage and the threshold voltage detection stage with the fourth thin film transistor. Thus, the reset time and the compensation time can be increased to effectively compensate the threshold voltage changes of the drive thin film transistor in each pixel and the display brightness of the AMOLED becomes more even to raise the display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 3:
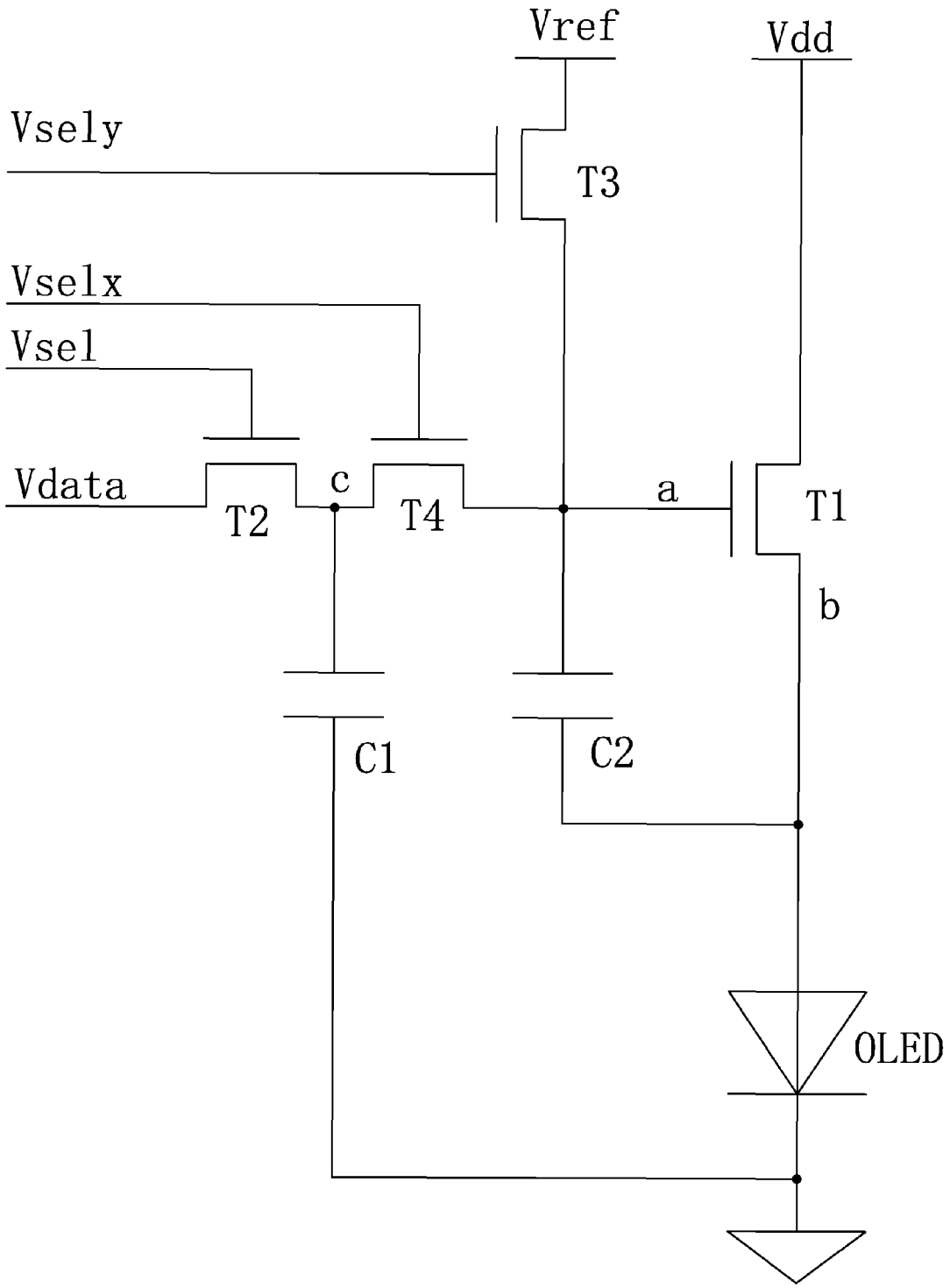
FIG. 3 is a circuit diagram of an AMOLED pixel driving circuit according to present invention.

Please refer to FIG. 3. The present invention first provides an AMOLED pixel driving circuit, and the AMOLED pixel driving circuit comprises: a first thin film transistor T1, a second thin film transistor T2, a third thin film transistor T3, a fourth thin film transistor T4, a first capacitor C1, a second capacitor C2 and an organic light emitting diode OLED.

a gate of the first transistor T1 is electrically coupled to a first node a, and a source is electrically coupled to a second node b, and a drain is electrically coupled to an alternating current power supply voltage Vdd;

a gate of the second thin film transistor T2 is electrically coupled to a scan signal voltage Vsel, and a source is electrically coupled to a data signal voltage Vdata, and a drain is electrically coupled to a third node c;

a gate of the third thin film transistor T3 is electrically coupled to a second global signal Vsely, and a source is electrically coupled to the first node a and a drain is electrically coupled to a reference voltage Vref;

a gate of the fourth thin film transistor T4 is electrically coupled to a first global signal Vselx, and a source is electrically coupled to the third node c, and a drain is electrically coupled to the first node a;

one end of the first capacitor C1 is electrically coupled to the third node c, and the other end is electrically coupled to a cathode of the organic light emitting diode OLED and an earth;

one end of the second capacitor C2 is electrically coupled to the first node a, and the other end is electrically coupled to the second node b;

an anode of the organic light emitting diode OLED is electrically coupled to the second node b, and the cathode is electrically coupled to the earth;

The first thin film transistor T1 is a drive thin film transistor.

Specifically, all of the first thin film transistor T1, the second thin film transistor T2, the third thin film transistor T3, the fourth thin film transistor T4 are Low Temperature Poly-silicon thin film transistors, oxide semiconductor thin film transistors or amorphous silicon thin film transistors. Both the first global signal Vselx and the second global signal Vsely are generated by an external sequence controller. The reference voltage Vref is a constant voltage.

Figure 4:
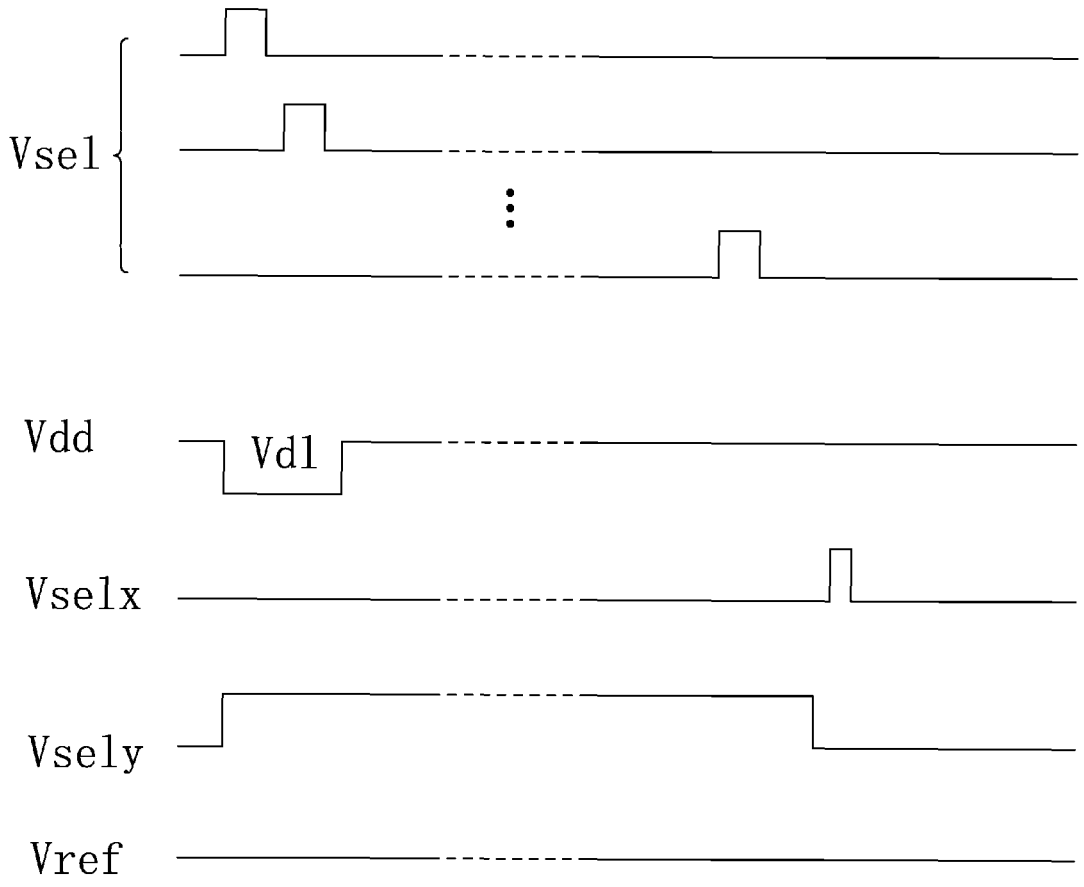
FIG. 4 is a sequence diagram of an AMOLED pixel driving circuit according to the present invention.
Figure 5:
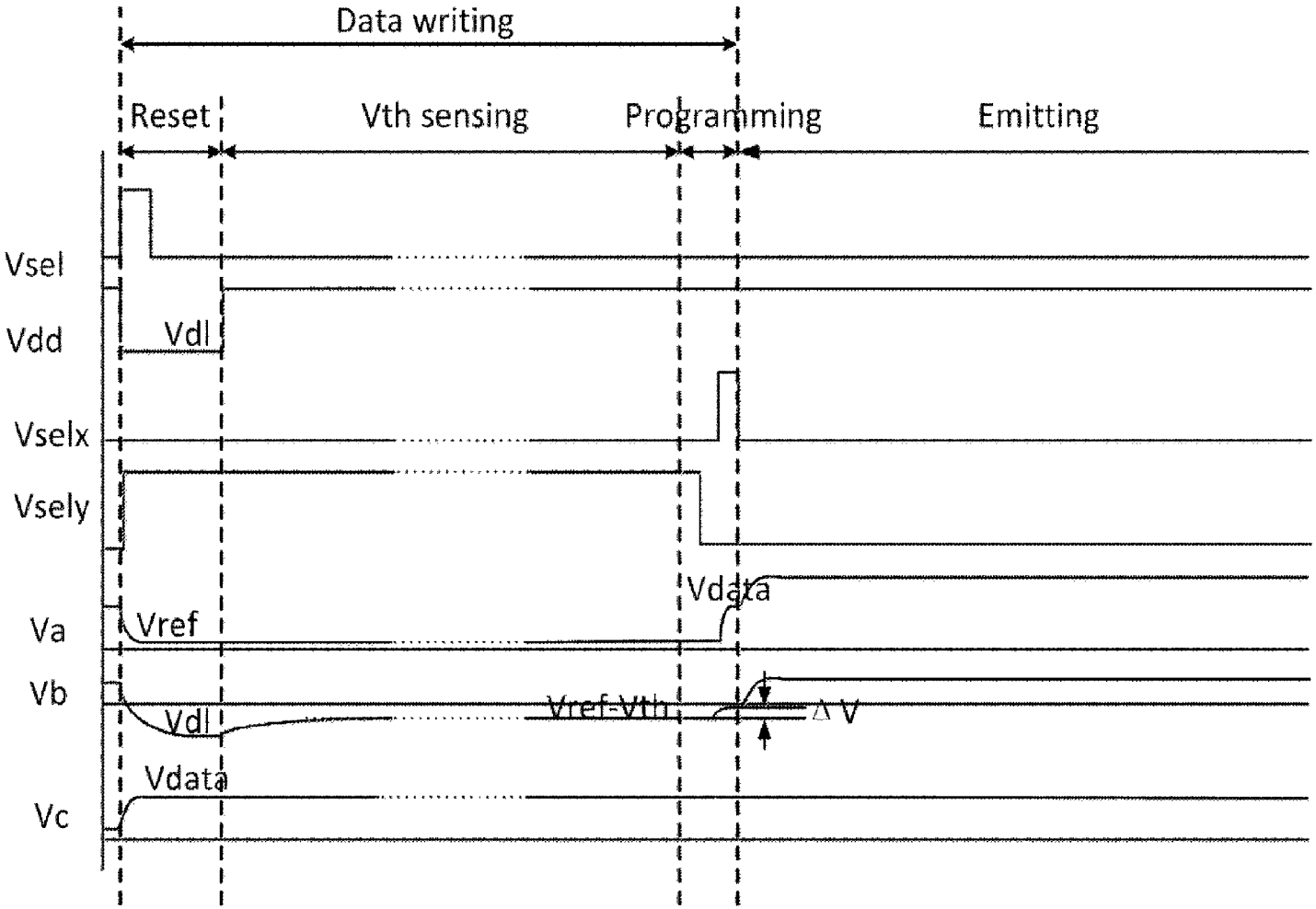
FIG. 5 is a voltage level diagram showing respective working stages and key nodes of an AMOLED pixel driving circuit according to present invention.

Furthermore, referring to FIG. 4 and FIG. 5, the first global signal Vselx, the second global signal Vsely, the scan signal voltage Vsel and the alternating current power supply voltage Vdd are combined with one another, and correspond to a reset stage Reset, a threshold voltage detection stage Vth sensing, a threshold voltage compensation stage Programming and a drive stage Emitting one after another.

In the reset stage Reset, the scan signal voltage Vsel and the second global signal Vsely are high voltage levels, and the first global signal Vselx and the alternating current power supply voltage Vdd are low voltage levels.

In the threshold voltage detection stage Vth sensing, the second global signal Vsely and the alternating current power supply voltage Vdd are high voltage levels, and the scan signal voltage Vsel and the first global signal Vselx are low voltage levels.

In the threshold voltage compensation stage Programming, the scan signal voltage Vsel and the second global signal Vsely are low voltage levels, and the first global signal Vselx and the alternating current power supply voltage Vdd are high voltage levels.

In the drive stage Emitting, the scan signal voltage Vsel, the first global signal Vselx and the second global signal Vsely are low voltage levels, and the alternating current power supply voltage Vdd is high voltage level.

The first global signal Vselx is employed to control the activation and deactivation of the fourth thin film transistor T4. Thus, the process of writing the data signal voltage Vdata into the first thin film transistor T1, i.e. the driving the thin film transistor is separated from the reset stage Reset and the threshold voltage detection stage Vth sensing. The first capacitor C1 is employed for storing the data signal voltage Vdata. The second global signal Vsely is employed to control the activation and deactivation of the third thin film transistor T3 to provide the reference voltage Vref to the first node a in the reset stage Reset and the threshold voltage detection stage Vth sensing. The scan signal voltage Vsel is employed to control the activation and deactivation of the second thin film transistor T2 to achieve the scan line by line and writing the data signal voltage Vdata into the third node C and the first capacitor C1. The data signal voltage Vdata is employed to control the brightness of the organic light emitting diode OLED.

The AMOLED pixel driving circuit can increase the reset time and the compensation time, and simplify the data signal voltage and diminish the complexity of the data signal voltage for effectively compensating the threshold voltage changes of the first thin film transistor T1, i.e. the drive thin film transistor. The display brightness of the AMOLED can be more even to raise the display quality.

Figure 6:
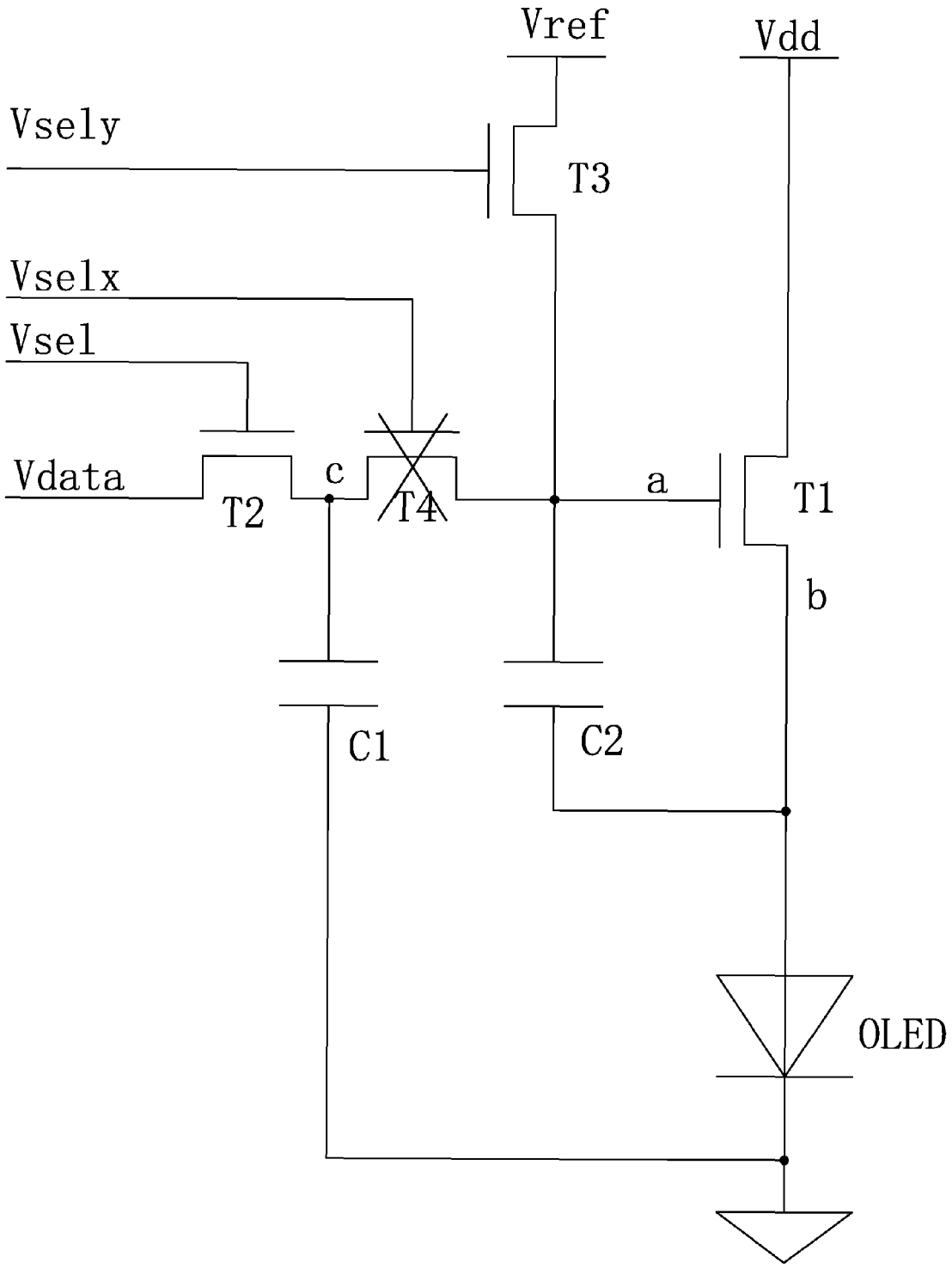
FIG. 6 is a diagram of the step 2 of an AMOLED pixel driving method according to the present invention.

Please refer from FIG. 6 to FIG. 9 in conjunction with FIG. 3 to FIG. 5. On the basis of the aforesaid AMOLED pixel driving circuit, the present invention further provides an AMOLED pixel driving method, comprising steps of:

step 1, providing an AMOLED pixel driving circuit utilizing the 4T2C structure as shown in the aforesaid FIG. 3, and the description of the circuit is not repeated here.

step 2, referring FIG. 6 in combination with FIG. 4, FIG. 5, first, entering the reset stage Reset.

The scan signal voltage Vsel and the second global signal Vsely provide high voltage levels, and the first global signal Vselx and the alternating current power supply voltage Vdd provide low voltage levels, and the first, the second, the third thin film transistors T1, T2, T3 are activated, and the fourth thin film transistor T4 is deactivated, and the data signal voltage Vdata is written into the third node c and the first capacitor C1 line by line, and the first node a is written with the reference voltage Vref, and the second node b is written with low voltage level Vdl of the alternating current power supply voltage Vdd.

In the reset stage Reset:

Vg=Va=Vref

Vs=Vb=Vdl

Figure 7:
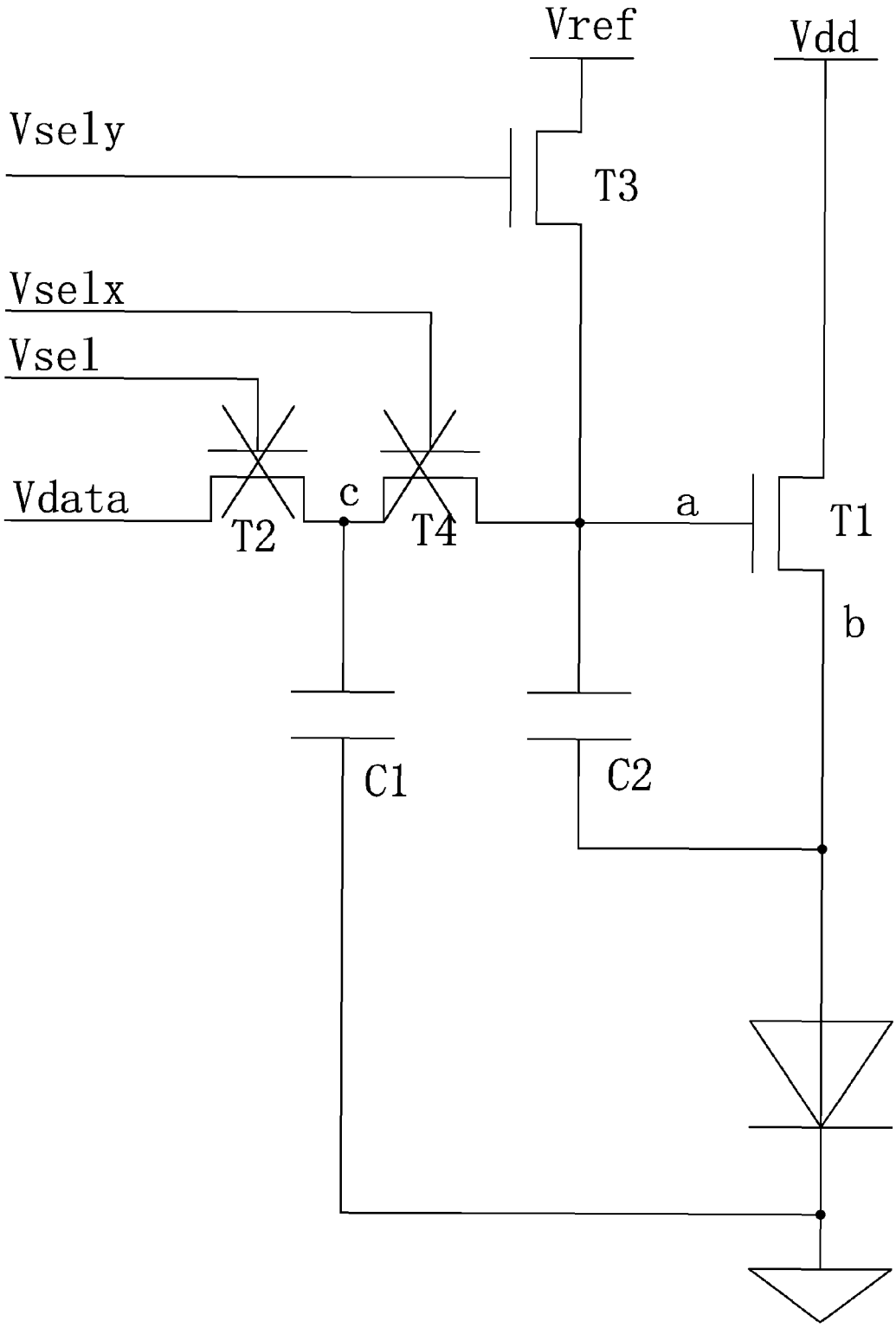
FIG. 7 is a diagram of the step 3 of an AMOLED pixel driving method according to the present invention.

Vc=Vdata wherein Vg represents the gate voltage of the first thin film transistor T1, and Va represents the voltage level of the first node a, and Vs represents the source voltage of the first thin film transistor T1, and Vb represents the voltage level of the second node b, and Vc represents the voltage level of the third node c;

the organic light emitting diode OLED does not emit light.

step 3, referring to FIG. 7 in combination with FIG. 4, FIG. 5, entering the threshold voltage detection stage Vth sensing.

The second global signal Vsely and the alternating current power supply voltage Vdd provide high voltage levels, and the scan signal voltage Vsel and the first global signal Vselx provide low voltage levels, and the first, the third thin film transistors T1, T3 are activated, and the second, the fourth thin film transistors T2, T4 are deactivated, and the data signal voltage Vdata is stored in the first capacitor C1, and the first node a is maintained at the reference voltage Vref, and the voltage level of the second node b is raised up to Vref−Vth, wherein Vth is the threshold voltage of the first thin film transistor T1.

In the threshold voltage detection stage Vth sensing:

Vg=Va=Vref

Figure 8:
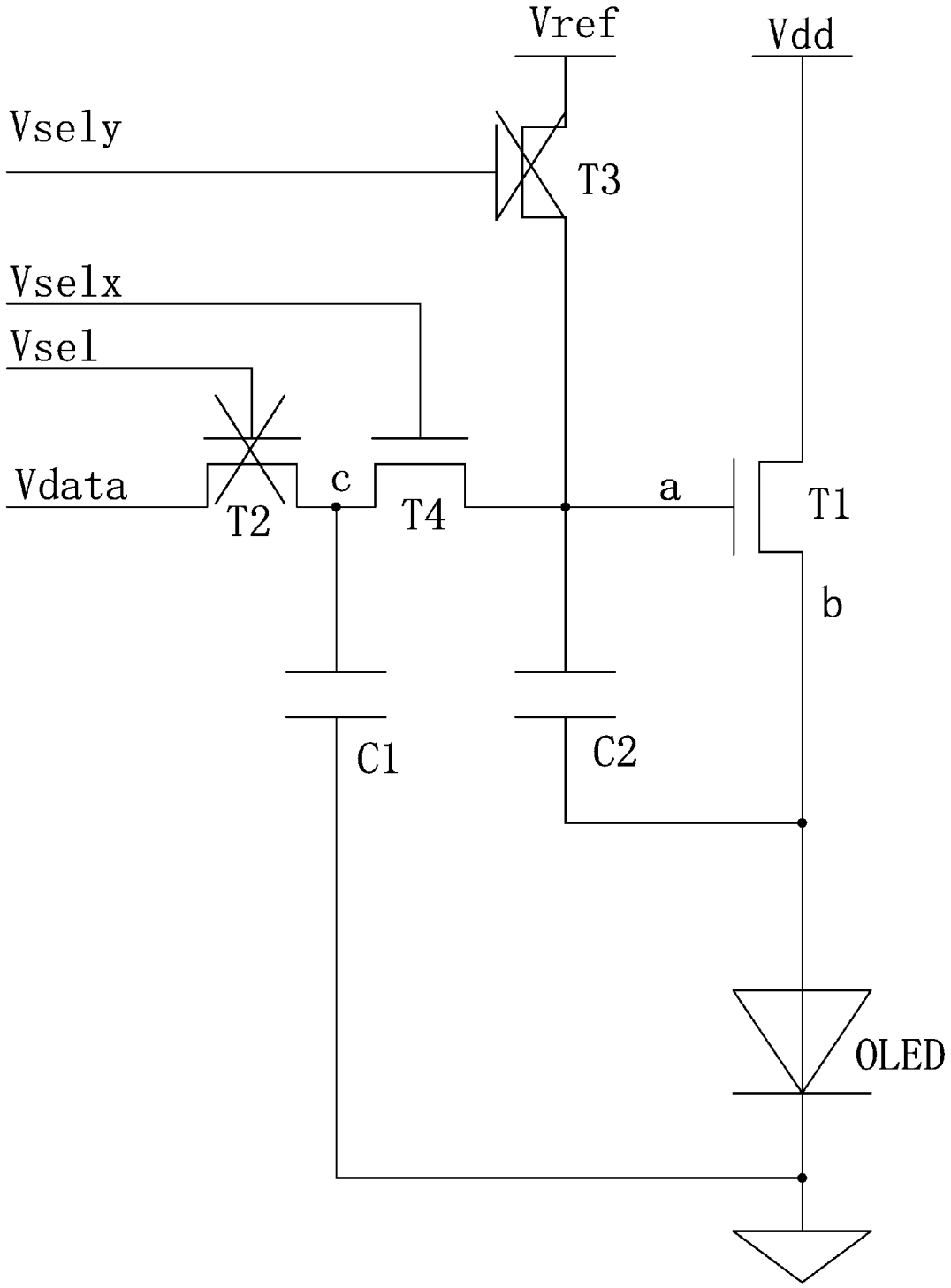
FIG. 8 is a diagram of the step 4 of an AMOLED pixel driving method according to the present invention.

Vs=Vb=Vref−Vth step 4, referring to FIG. 8 in combination with FIG. 4, FIG. 5, entering the threshold voltage compensation stage Programming.

The scan signal voltage Vsel and the second global signal Vsely provide low voltage levels, and the first global signal Vselx and the alternating current power supply voltage Vdd provide high voltage levels, and the second, the third thin film transistors T2, T3 are deactivated, and the first, the fourth thin film transistors T1, T4 are activated, and the data signal voltage Vdata stored in the first capacitor C1 is written into the first node a, and the voltage level of the first node a is changed to the data signal voltage Vdata, and the voltage level of the second node b is changed to Vref−Vth+ΔV, and ΔV is the influence generated by the data signal voltage Vdata to the source voltage Vs of the first thin film transistor T1, i.e. the voltage level of the second node b.

In the threshold voltage compensation stage Programming:

Vg=Va=Vdata

Figure 9:
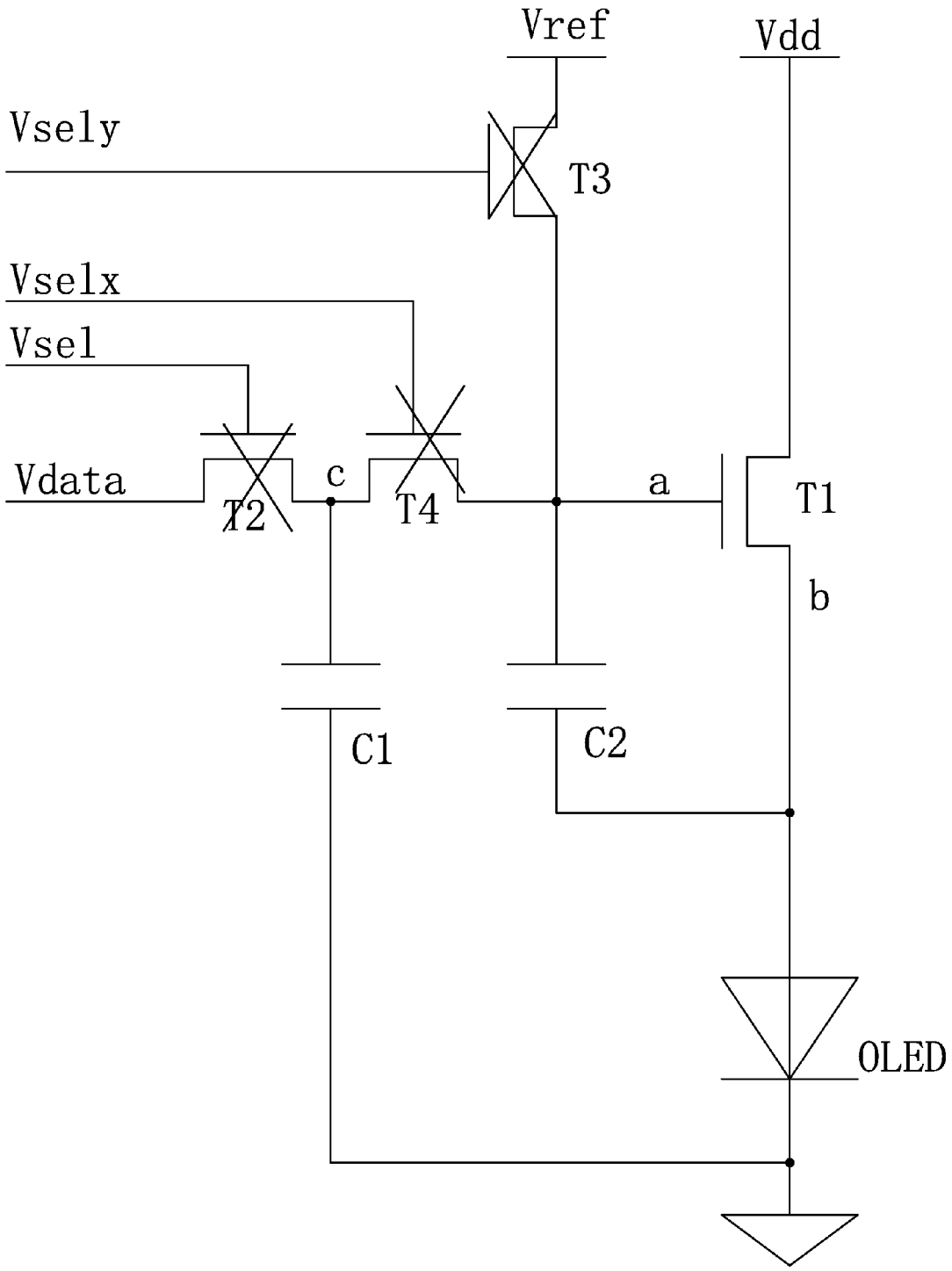
FIG. 9 is a diagram of the step 5 of an AMOLED pixel driving method according to the present invention.

Vs=Vb=Vref−Vth+ΔV step 5, referring to FIG. 9 in combination with FIG. 4, FIG. 5, entering the drive stage Emitting.

All the scan signal voltage Vsel, the first global signal Vselx and the second global signal Vsely provide low voltage levels, and the alternating current power supply voltage Vdd provide high voltage levels, and the second, the third, the fourth thin film transistors T2, T3, T4 are deactivated, and the first thin film transistor T1 is activated, and with the storage function of the second capacitor C2, the voltage level of the first node a, i.e. the gate voltage Vg of the first thin film transistor T1 is maintained to be:

Vg=Va=Vdata;

the voltage level of the second node b, i.e. the source voltage Vs of the first thin film transistor T1 remains to be:

Vs=Vb=Vref−Vth+ΔV;

Furthermore, as known, the formula of calculating the current flowing through the organic light emitting diode OLED is:

$$I_{OLED}=\tfrac{1}{2}\mathrm{Cox}(\mu W/L)(Vgs-Vth)^2 \quad (1)$$

wherein $I_{OLED}$ is the current of the organic light emitting diode OLED, and μ is the carrier mobility of drive thin film transistor, and W and L respectively are the width and the length of the channel of the drive thin film transistor, and Vgs is the voltage between the gate and the source of the drive thin film transistor, and Vth is the threshold voltage of the drive thin film transistor. In the present invention, the threshold voltage Vth of the drive thin film transistor, i.e. the threshold voltage Vth of the first thin film transistor T1; Vgs is the difference between the gate voltage Vg and the source voltage Vs of the first thin film transistor T1, which is:

$$Vgs=Vg-Vs=V\mathrm{data}-(V\mathrm{ref}-V\mathrm{th}+\Delta V)=V\mathrm{data}-V\mathrm{ref}+V\mathrm{th}-\Delta V \quad (2)$$

the equation (2) is substituted into equation (1) to derive:

$$I_{OLED} = 1/2Cox(\mu W/L)(Vdata - Vref + Vth - \Delta V - Vth)^2$$

$$= 1/2Cox(\mu W/L)(Vdata - Vref - \Delta V)^2$$

Consequently, the current $I_{OLED}$ flowing through the organic light emitting diode OLED is irrelevant with the threshold voltage of the first thin film transistor T1 to realize the compensation function. The organic light emitting diode OLED emits light, and the current $I_{OLED}$ flowing through the organic light emitting diode OLED is irrelevant with the threshold voltage of the first thin film transistor T1.

Figure 1:
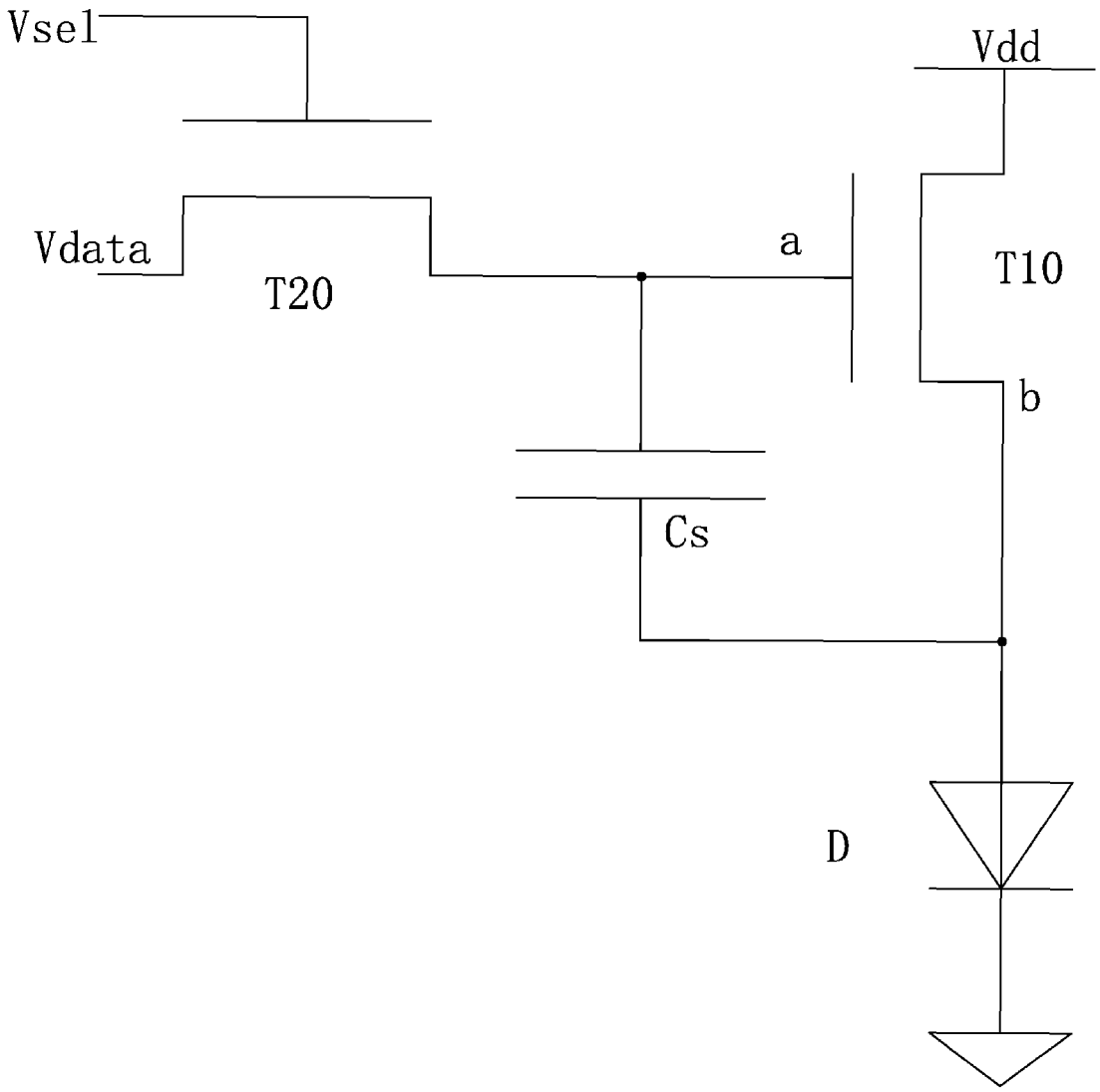
Fig. 1(Prior Art)
FIG. 1 is a circuit diagram of 2T1C pixel driving circuit employed for AMOLED according to prior art.
Figure 2:
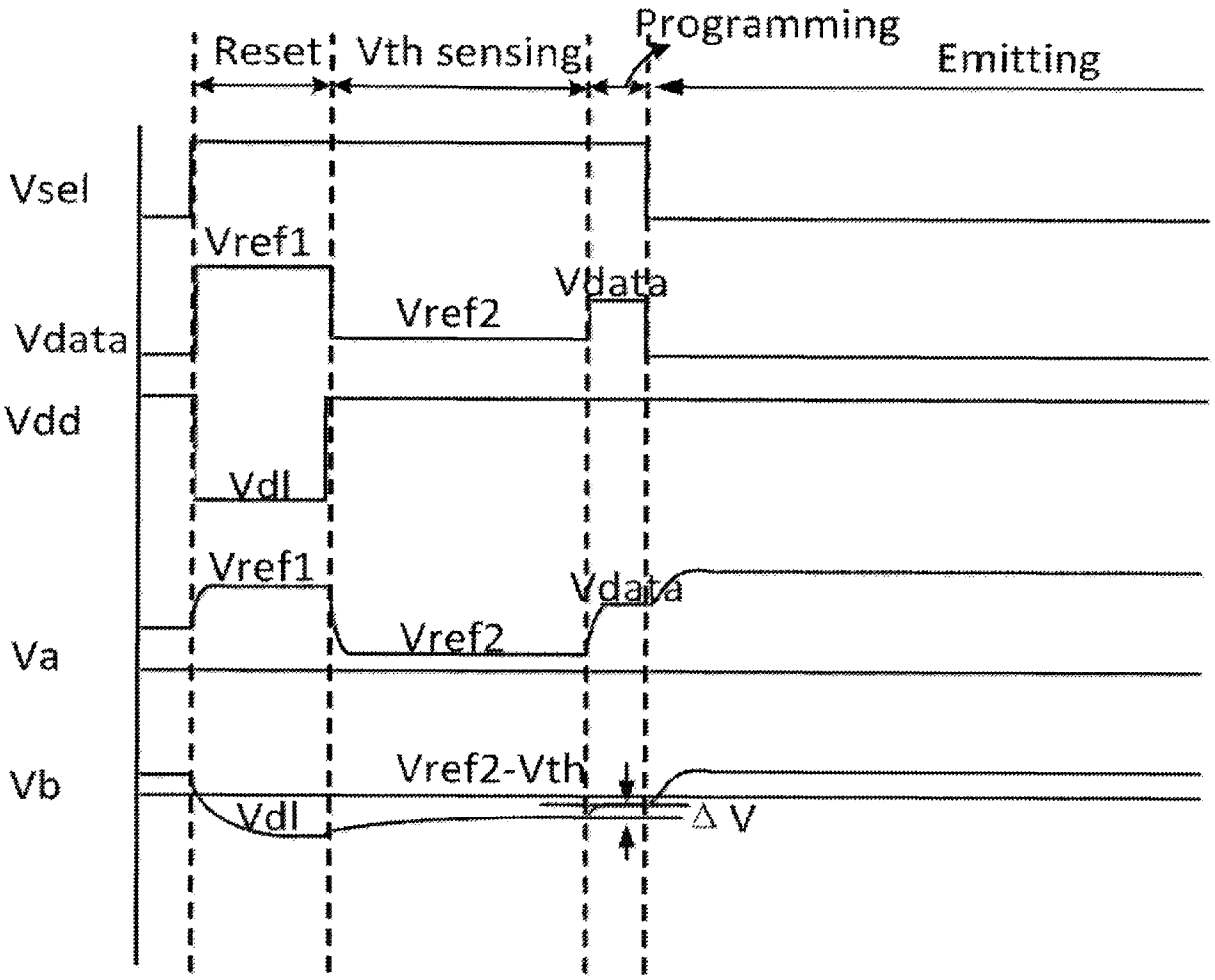
Fig. 2 (Prior Art)
FIG. 2 is a sequence diagram in accordance with the 2T1C pixel driving circuit in FIG. 1, which is employed for AMOLED.
Figure 10:
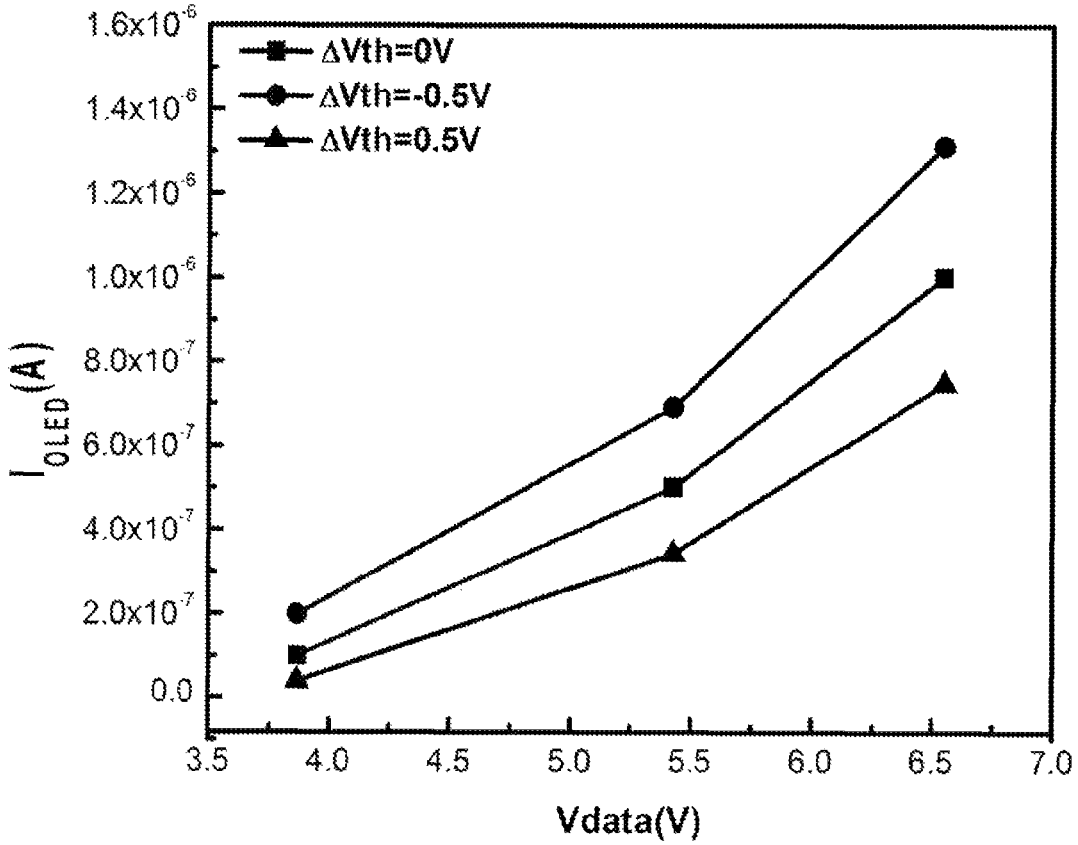
FIG. 10 is a simulation diagram of the corresponding current flowing through the OLED as the threshold voltage of the drive thin film transistor shown in FIG. 1 drifts.
Figure 11:
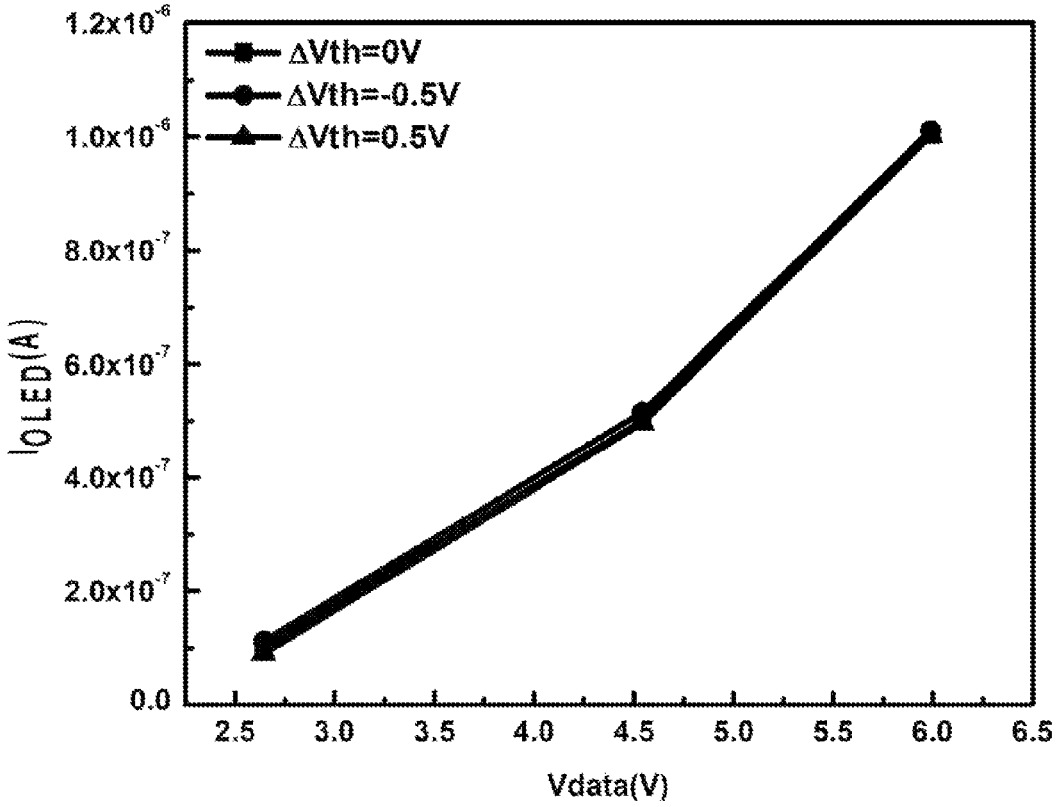
FIG. 11 is a simulation diagram of the corresponding current flowing through the OLED as the threshold voltage of the drive thin film transistor in the present invention drifts.

Please refer to FIG. 10, FIG. 11. FIG. 10 and FIG. 11 respectively are simulation diagrams of the current flowing through the organic light emitting diode as the threshold voltage of the drive thin film transistor, i.e. the first thin film transistor shown in FIG. 1 drifts 0V, +0.5V, −0.5V according to prior art and the present invention. By comparing two figures, it can be seen that the change of the current flowing through the organic light emitting diode in the circuit according to the present invention is obviously smaller than the change of the current flowing through the organic light emitting diode in the circuit according to prior art as shown in FIG. 1. Therefore, the present invention effectively compensates the threshold voltage of the driving thin film transistor for ensuring the light emitting stability of the organic light emitting diode OLED to make the brightness of the AMOLED more even and raise the display quality.

In conclusion, in the AMOLED pixel driving circuit and a pixel driving method provided by the present invention, the pixel driving circuit utilizing the 4T2C structure implements compensation to the threshold voltage of the drive thin film transistor in each of the pixels. By providing the reference voltage to the first node via the third thin film transistor, the data signal voltage can be simplified to diminish the complexity of the data signal voltage. The process of writing the data signal voltage into the driving the thin film transistor is separated from the reset stage and the threshold voltage detection stage with the fourth thin film transistor. Thus, the reset time and the compensation time can be increased to effectively compensate the threshold voltage changes of the drive thin film transistor in each pixel and the display brightness of the AMOLED becomes more even to raise the display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a first capacitor, a second capacitor and an organic light emitting diode;

a gate of the first transistor is electrically coupled to a first node, and a source is electrically coupled to a second node, and a drain is electrically coupled to an alternating current power supply voltage;

a gate of the second thin film transistor is electrically coupled to a scan signal voltage, and a source is electrically coupled to a data signal voltage, and a drain is electrically coupled to a third node;

a gate of the third thin film transistor is electrically coupled to a second global signal, and a source is electrically coupled to the first node and a drain is electrically coupled to a reference voltage;

a gate of the fourth thin film transistor is electrically coupled to a first global signal, and a source is electrically coupled to the third node, and a drain is electrically coupled to the first node;

one end of the first capacitor is electrically coupled to the third node, and the other end is electrically coupled to a cathode of the organic light emitting diode and an earth;

one end of the second capacitor is electrically coupled to the first node, and the other end is electrically coupled to the second node;

an anode of the organic light emitting diode is electrically coupled to the second node, and the cathode is electrically coupled to the earth;

the first thin film transistor is a drive thin film transistor;

step 2, entering a reset stage;

the scan signal voltage and the second global signal provide high voltage levels, and the first global signal and the alternating current power supply voltage provide low voltage levels, and the first, the second, the third thin film transistors are activated, and the fourth thin film transistor is deactivated, and a data signal voltage is written into the third node and the first capacitor line by line, and the first node is written with a reference voltage, and the second node is written with low voltage level of the alternating current power supply voltage;

step 3, entering a threshold voltage detection stage;

the second global signal and the alternating current power supply voltage provide high voltage levels, and the scan signal voltage and the first global signal provide low voltage levels, and the first, the third thin film transistors are activated, and the second, the fourth thin film transistors are deactivated, and the data signal voltage is stored in the first capacitor, and the first node is maintained at the reference voltage, and a voltage level of the second node is raised up to Vref−Vth, wherein Vth is a threshold voltage of the first thin film transistor;

step 4, entering a threshold voltage compensation stage;

the scan signal voltage and the second global signal provide low voltage levels, and the first global signal and the alternating current power supply voltage provide high voltage levels, and the second, the third thin film transistors are deactivated, and the first, the fourth thin film transistors are activated, and the data signal voltage stored in the capacitor is written into the first node, and a voltage level of the first node is changed to the data signal voltage, and the voltage level of the second node is changed to Vref−Vth+ΔV, and ΔV is an influence generated by the data signal voltage to a source voltage of the first thin film transistor, which is the voltage level of the second node;

step 5, entering a drive stage;

all the scan signal voltage, the first global signal and the second global signal provide low voltage levels, and the alternating current power supply voltage provide high voltage levels, and the second, the third, the fourth thin film transistors are deactivated, and the first thin film transistor is activated, and with the storage function of the second capacitor, the voltage level of the first node, which is the gate voltage level of the first thin film transistor is maintained to be:

$$Vg=Va=Vdata$$

wherein Vg represents a gate voltage level of the first thin film transistor, and Va represents a voltage level of the first node;

the voltage of the second node, i.e. the source voltage of the first thin film transistor remains to be:

$$Vs=Vb=Vref-Vth=\Delta V$$

wherein Vs represents a source voltage level of the first thin film transistor, and Vb represents the voltage level of the second node;

the organic light emitting diode emits light, and a current flowing through the organic light emitting diode is irrelevant with the threshold voltage of the first thin film transistor.

2. The AMOLED pixel driving method according to claim 1, wherein all of the first thin film transistor, the second thin film transistor, the third thin film transistor and the fourth thin film transistor are Low Temperature Poly-silicon thin film transistors, oxide semiconductor thin film transistors or amorphous silicon thin film transistors.

3. The AMOLED pixel driving method according to claim 1, wherein both the first global signal and the second global signal are generated by an external sequence controller.

4. The AMOLED pixel driving method according to claim 1, wherein the reference voltage is a constant voltage.

* * * * *